United States Patent [19]

Lee et al.

[11] Patent Number: 4,902,361

[45] Date of Patent: Feb. 20, 1990

[54] BONDED RARE EARTH-IRON MAGNETS

[75] Inventors: Robert W. Lee, Troy; John J. Croat, Sterling Heights, both of Mich.

[73] Assignee: General Motors Corporation, Detroit, Mich.

[21] Appl. No.: 827,911

[22] Filed: Feb. 10, 1986

Related U.S. Application Data

[63] Continuation of Ser. No. 492,629, May 9, 1983, abandoned.

[51] Int. Cl.[4] ..... H01F 1/04

[52] U.S. Cl. ..... 148/302; 75/230; 75/244

[58] Field of Search ..... 148/31.57, 403, 442, 148/302; 420/416, 435, 455, 581, 583, 587, 83, 121; 75/123 B, 123 E, 230, 244

[56] References Cited

U.S. PATENT DOCUMENTS

| | | | |
|---|---|---|---|
| 3,560,200 | 2/1971 | Nesbitt et al. | 148/31.57 |
| 3,919,004 | 11/1975 | Benz | 148/31.57 |
| 3,985,588 | 10/1976 | Lyman | 148/31.57 |
| 4,289,549 | 9/1981 | Kasai | 148/31.57 |
| 4,375,372 | 3/1983 | Koon et al. | 75/123 E |
| 4,378,258 | 3/1983 | Clark et al. | 75/123 E |
| 4,402,770 | 9/1983 | Koon | 75/123 E |
| 4,558,077 | 12/1985 | Gray | 523/458 |

FOREIGN PATENT DOCUMENTS

| | | | |
|---|---|---|---|
| 52-50598 | 4/1977 | Japan | 420/416 |
| 55-115304 | 9/1980 | Japan | 148/103 |
| 56-47538 | 4/1981 | Japan | 75/123 E |
| 57-141901 | 9/1982 | Japan . | |

*Primary Examiner*—John P. Sheehan

*Attorney, Agent, or Firm*—Elizabeth F. Harasek

[57] ABSTRACT

This invention relates to permanent bonded magnets of very finely crystalline, melt-spun, rare earth-iron alloys. The compacts are magnetically isotropic.

5 Claims, 3 Drawing Sheets

BONDED RARE EARTH-IRON MAGNETS

This is a continuation of Ser. No. 492,629, filed 5/9/83, now abandoned.

This invention relates to bonded particle permanent magnets and to a method of making them. In accordance with the invention, such magnets are readily fabricated into desired shapes from melt-spun rare earth-iron alloy ribbons. These magnets have intrinsic coercivities and energy products on the same order as samarium-cobalt magnets but are much less costly. The bonded magnet compacts are magnetically isotropic. They may be readily magnetized in any preferred direction in a suitable magnetic field.

BACKGROUND

There has long been a need for relatively inexpensive but very strong permanent magnets. Therefore, considerable work has been done on the development of alloys and processes for making magnets of exceptional strength.

Before this invention, sintered or bonded samarium-cobalt (Sm-Co) powder magnets have been used in applications where high magnetic remanence and coercivity are needed in a shaped permanent magnet. However, such Sm-Co powder magnets are very expensive. The high price is a function of both the cost of the metals and the cost of their manufacture into magnets. Samarium is one of the least abundant rare earth elements, while cobalt is a critical metal with unreliable worldwide availability.

Processing Sm-Co powder magnets involves many critical steps. One such step is grinding alloy ingot into very fine powder. Ideally, each powder particle is a single crystal that is inherently magnetically anisotropic. To obtain an oriented permanent magnet, the anisotropic powder particles must be oriented in a magnetic field before the position of each particle is fixed by sintering or bonding. After sintering or bonding, the magnet must be finally magnetically aligned in the same direction in which the particles were initially oriented to obtain optimum magnetic properties, That is, the magnets are anisotropic. Sintered Sm-Co magnets may approach densities nearing 100% of alloy density. For bonded Sm-Co magnets, however, it is difficult to obtain densities much greater than about 75%. Conventional powder metal compaction equipment is not capable of achieving higher packing densities because of the shape and hardness of the powder particles.

This invention relates to high density, bonded, rare earth-transition metal magnets with properties nearly rivaling bonded samarium cobalt magnets. However, these novel magnets are based on the relatively common and inexpensive light rare earth elements, neodymium and praseodymium; the transition metal element, iron; and boron. These alloys and the method by which they are processed to achieve superior hard magnetic properties are described in detail in U.S. Ser. No. 414,936 now U.S. Pat. No. 4,851,058 by John Croat, a co-inventor of this invention. The application is assigned to the assignee hereof.

For use in this invention, the magnetic alloys are made by melt-spinning. Melt-spinning is a process by which a molten stream of alloy is impinged on the perimeter of a rotating quench wheel to produce rapidly quenched alloy ribbons. These ribbons are relatively brittle and have a very finely crystalline microstructure.

They may be compacted and bonded as will be described hereafter to create novel, isotropic, high density, high performance permanent magnets.

BRIEF SUMMARY

In accordance with a preferred practice of the subject invention, we create isotropic, bonded particle magnets with compact densities of at least about 75% of the constituent RE-Fe alloy density. Unexpectedly, we do not have to grind the constituent alloy into a fine powder in order to obtain a magnet with high magnetic remanence. Rather, melt-spun rare earth-iron ribbon is simply compacted in a powder metal die in a suitable press.

At compaction pressures of about 160,000 psi, a compact with a density of about 80% is achieved. The melt-spun ribbons fracture during compaction into brick-like segments, each containing many randomly oriented crystallites. These segments pack together very closely, promoting both high compact density and green strength. The green compacts can be easily handled without damage. On the other hand, we have found that compacting spherical powder particles of like alloy will not yield a green compact with any appreciable green strength. The compacts are so weak they cannot be removed from a die without fracture.

A preferred alloy for use herein would be a melt-spun form of $Nd_{0.15}(Fe_{0.95}B_{0.05})_{0.85}$ alloy having a suitable finely crystalline microstructure. The ribbon itself is magnetically isotropic. It need not be magnetized before or during compaction.

After pressing, the ribbon particles of the green compact are coated with a binder agent which may be later hardened to form a self-supporting, unmagnetized but magnetizable, magnetically isotropic, composite body. The binder agent may be a hardenable resinous substance such as an epoxy; a lower melting metal such as lead-tin solder; or any other suitable organic or inorganic binder.

By practicing this invention, one can now make a magnetizable body of bonded melt-spun alloy ribbons in almost any desired shape. The ribbon segments may be compacted to high density in almost any conventional die press. Furthermore, the compacts are magnetically isotropic. That is, they may be magnetized in any desired direction to achieve optimum properties for a particular application.

For example, arcuate shaped field magnets for direct current motors could be formed by compacting melt-spun rare earth-iron ribbon in a punch and die set. These arcuate shaped bodies would first be magnetized after compaction in an applied magnetic field in which the field lines radially intersect the compact to induce radially oriented, remanent magnetization. In like manner, a bonded magnet of any other shape could be magnetized in a magnetic field having field lines oriented in any desired direction.

The invention will be better understood in view of the Figures and detailed description which follow.

FIGURES

FIGS. 1(*a*) to 1(*d*) are schematic illustrations of the manufacture of a right circular cylindrical shaped magnet in accordance with the invention.

DETAILED DESCRIPTION AND EXAMPLES

Figure 1A:
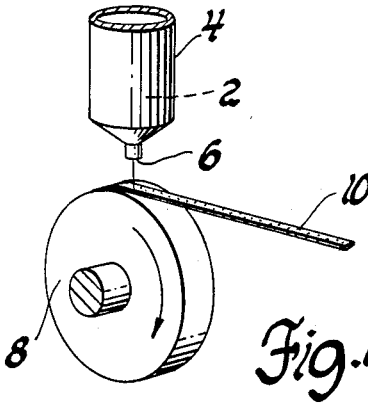
Figure 1B:
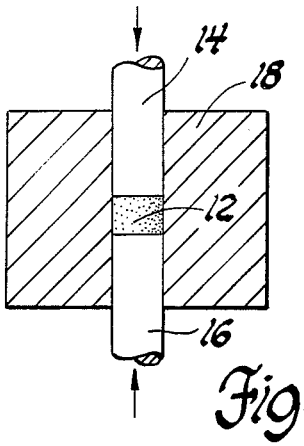
Figure 1C:
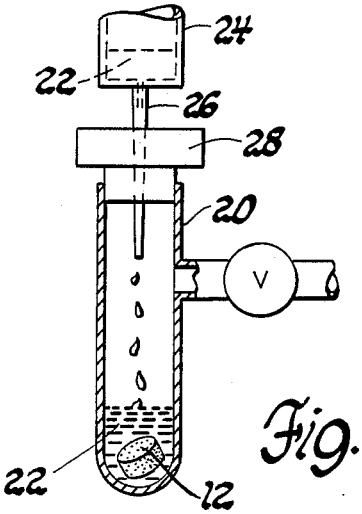
Figure 1D:
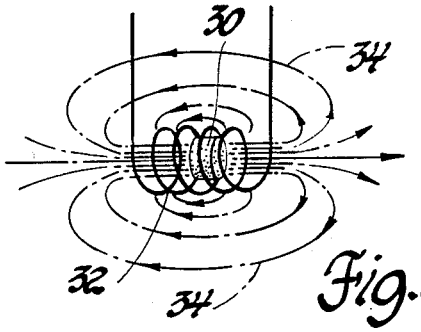

In accordance with a preferred embodiment of the invention, iron, rare earth elements and a small amount of boron are melted and rapidly quenched by the melt spinning process to create relatively brittle alloy ribbons. These alloys have high inherent intrinsic coercivities on the order of a kiloOersted or more, some higher than twenty kilooersteds and remanent magnetization on the order of 8 kiloGauss. Such high coercivities and high remanent magnetism are believed to be due to the presence of a very finely crystalline phase (atomic ordering less than about 500 nanometers) composed of iron and low atomic weight rare earth elements (atomic No. less than or equal to 62) that do not have full or exactly half full f-orbitals. The phase is stabilized by the presence of a small amount of boron. U.S. Ser. Nos. 274,070, now U.S. Pat. No. 4,496,395 and 414,936, now U.S. Pat. No. 4,851,058 describe suitable compositions and methods of making such and are incorporated herein by reference.

With particular reference to U.S. Ser. No. 414,936 and in accordance with a preferred practice of the invention, an alloy with hard magnetic properties is formed having the basic formula $RE_{1-x}(TM_{1-y}B_y)_x$.

In this formula, RE represents one or more rare earth elements taken from the group of elements including scandium and yttrium in group IIIA of the periodic table and the elements from atomic number 57 (lanthanum) through 71 (lutetium). The preferred rare earth elements are the lower atomic weight members of the lanthanide series, particularly Nd and Pr which should be present in an amount of at least about six atomic percent. TM herein is used to symbolize transition metal(s) including Fe, Ni and Co, iron being preferred for its relatively high magnetic remanence and low cost. Iron should be present in an amount of at least about 40 atomic percent and more than about 50% of the total TM content of an alloy. B represents the element boron. X is the combined atomic fraction of the TM and B present in a said composition and generally x is between about 0.5 and 0.9. Y is the atomic fraction of B present in the composition based on the amount of B and TM present. The preferred range for y is between about 0.01 and 0.2. The preferred amount of B is therefore about 18% or less. The incorporation of only a small amount of boron in the compositions was found to substantially increase the coercivity of RE-Fe alloys at temperatures up to 200° C. or greater, particularly those alloys having high iron concentrations. Other metals may be incorporated in small amounts.

A preferred method of making the high coercivity alloys is to melt suitable amounts of the elements together and then quench a stream of the alloy on the perimeter of a spinning quench wheel to create a friable alloy ribbon with a very finely crystalline microstructure. This process is referred to herein as melt-spinning.

FIG. 1 is a schematic representation of a method for making bonded permanent magnets in accordance with the invention. Referring to FIG. 1(*a*), the alloy 2 is melted in a crucible 4 and ejected through a small orifice 6. The ejected stream of alloy impinges on a rotating quench wheel 8 to form a ribbon 10 of solidified alloy with a very finely crystalline phase. Ribbon 10 is generally quite thin and very brittle. It can be broken into pieces small enough to fit into a die cavity by almost any crushing means. We have, for example, placed melt-spun ribbons between two clean sheets of paper and rolled an ordinary wooden writing pencil over the sandwich. The resultant ribbon segments can be poured directly into a die cavity. We have found that ball-milling or otherwise milling the ribbon in air creates smaller ribbon sections but does not cause any detectable loss of magnetic properties or compactability in conventional tooling. We have, however, noted some deterioration of magnetic properties when ribbons are ground for excessively long periods of time.

FIG. 1(*b*) shows a die for making a cylindrical compact 12. The compact is formed between a pair of opposing punches 14 and 16 in tool 18. This process is referred to herein as uniaxial compaction, the axis being parallel to the travel of the compaction punches. We have found that under ordinary conditions for making conventional powder metal compacts of iron or other such metal powders, we can make rare earth-iron compacts of eighty percent density or greater. The compacting process apparently tends to fracture the subject RE-Fe ribbon segments and pack them together in a manner such that the ribbon sections lie parallel and directly adjacent to each other almost as the bricks in a brick wall are oriented with respect to one another. Each ribbon segment is much larger than a single magnetic domain. It is magnetically isotropic and is readily magnetized to a strong permanent magnet in an applied magnetic field.

As shown at FIG. 1(*c*), once a desired compact density is achieved, compact 12 is removed from the press and placed in side-arm tube 20. A hardenable liquid resin 22 is retained in a syringe 24. Syringe needle 26 is inserted through stopper 28 and a vacuum is drawn through the side arm of tube 20. Once tube 20 is evacuated, enough resin 22 is dripped onto compact 12 to saturate the pores between particles. The resin is then cured and any excess is machined away.

This bonded body 30 need not be magnetized when it is formed. Permanent magnetism is induced in the bonded compact body 30 by exposing it to a magnetic field of suitable direction and field strength. The field may be created by suitable magnetizing means such as a magnetic induction coil 32. Coil 32 is activated to create a field represented by flux lines 34. The flux lines 34 run parallel to the axis of the cylindrical bonded body 30.

Clearly, in accordance with this invention, magnets can be formed in almost any shape that is adaptable to formation by powder metal pressing techniques such as uniaxial compaction in a rigid die or isostatic compaction in a flexible sleeve. A key advantage of this method over the conventional methods of making particulate Sm-Co magnets is that the compaction need not take place concurrently with magnetization. Nor do the ribbons have to be ground to a size commensurate with single domain size. The rare earth-iron alloy ribbon of this invention is isotropic and need not be magnetized until after the bonded magnet is fully formed. This simplifies the magnet making process and eliminates all the problems associated with grinding fine powders and handling magnetized green compacts. We have achieved unexpectedly high remanent magnetizations of 7 kiloGauss (at least 6 kiloGauss being desired) and energy products of 9 megaGauss Oersted or more.

How the quenched alloy particles are coated or impregnated to effect binding is not critical to this invention. While the preferred practice, to date, employs hardenable liquid epoxy binder resin, any other type of polymeric resin that does not interfere with the magnetic properties of the rare earth-iron alloys would be suitable. In fact, most any type of organic or inorganic binder may be used so long as it does not adversely effect the magnetics of the alloys.

For example, a very thin layer of lead or other low melting metal could be sputtered or sprayed onto melt-spun alloy ribbon before compacting. The compact could then be heated to melt the lead and bons the particles. Another practice would be to blend melt-spun RE-Fe ribbon fragments with a dry resin powder. After compaction, the resin would be cured or melted at a suitable elevated temperature to bond the alloy particles.

It is only necessary to achieve adequate bonding strength to stabilize the motion of the constituent alloy particles for whatever application in which the magnet body is to be used. In some cases, a wax binder would be sufficient; in others, a relatively rugged and highly adhesive binder such as an epoxy would be more advantageous.

Another clear advantage of the invention is that the direction of magnetization of the bonded rare earth-iron body can be tailored to a desired application. The body is first magnetized after it is shaped and the alloy particles are mechanically bonded. Thus, the unmagnetized body is simply placed in a magnetic field of desired direction and adequate strength to establish its remanent magnetic direction and energy product. The magnet bodies can be made and stored in an unmagnetized state and be magnetized immediately before use. A preferred practice would be to install a bonded compact in the device in which it will be used and only then magnetize it in situ.

The neodymium-iron alloys of the following examples were all made by melt spinning. The melt spinning tube was made of quartz and measured about 4 inches long and ½ inch in diameter. About 5 grams of premelted and solidified mixtures of pure neodymium, iron and boron metals were melt spun during each run. The mixtures were remelted in the quartz tube by means of an induction coil surrounding it. An ejection pressure of about 5 psi was generated in the tube with argon gas. The ejection orifice was round and about 500 microns in diameter. The orifice was located about ⅛ to ¼ inches from the chill surface of the cooling disc. The disc was rotated at a constant revolution rate such that the velocity of a point on the perimeter of the disc was about 15 meters per second. The chill disc was originally at room temperature and was not externally cooled. The resultant melt spun ribbons were about 30–50 microns thick and about 1.5 millimeters wide. They were brittle and easily broken into small pieces. Melt spun ribbons processed in this manner exhibited optimum magnetic properties for a given RE-Fe-B composition.

EXAMPLE 1

A 15 gram sample of melt-spun $Nd_{0.2}(Fe_{0.95}B_{0.05})_{0.8}$ ribbon was ground in an argon atmosphere in a vibrating mill (Shatterbox, Spex Industries). The resultant powder was sieved to a particle size less than about 45 microns.

The powder was then placed in a rubber tube with an internal diameter of 8 mm. Rubber plugs sized to be slidable within the tube were inserted in either end. Steel rams were then inserted in either end of the tube. This assembly was placed in a pulsed magnetizing coil having a field strength of 40 kOe. The field was pulsed, drawing the rams together and causing the plugs to compress and lightly compact the powder between them. If the powder particles were magnetically anisotropic, this pulsed pressing step would physically orient them along their individual preferred magnetic axes.

The rams were removed from the tube and the excess rubber sleeve was trimmed away. The plugged tube was then reinserted into a hydraulic press and compacted between rams to a pressure of 160,000 pounds per square inch (kpsi).

The resultant right circular cylindrical compact measured 8 mm high and 8 mm in diameter. The compact could be handled without breaking. It was taken out of the rubber compaction tube and placed in a side arm pyrex test tube. The tube was evacuated with a mechanical vacuum pump. A hypodermic needle attached to a syringe carrying liquid epoxy resin was then inserted through the rubber stopper of the tube. The resin was dropped into the tube to saturate the compact. The epoxy was a conventional commercially available epoxy comprised of a diglycidyl ether of bisphenol-A diluted with butyl glycidyl ether and cured with 2-ethyl-4-methyl-imidazole. The compact was removed and allowed to cure overnight (approximately 16 hours) in air at 100° C.

Figure 2:
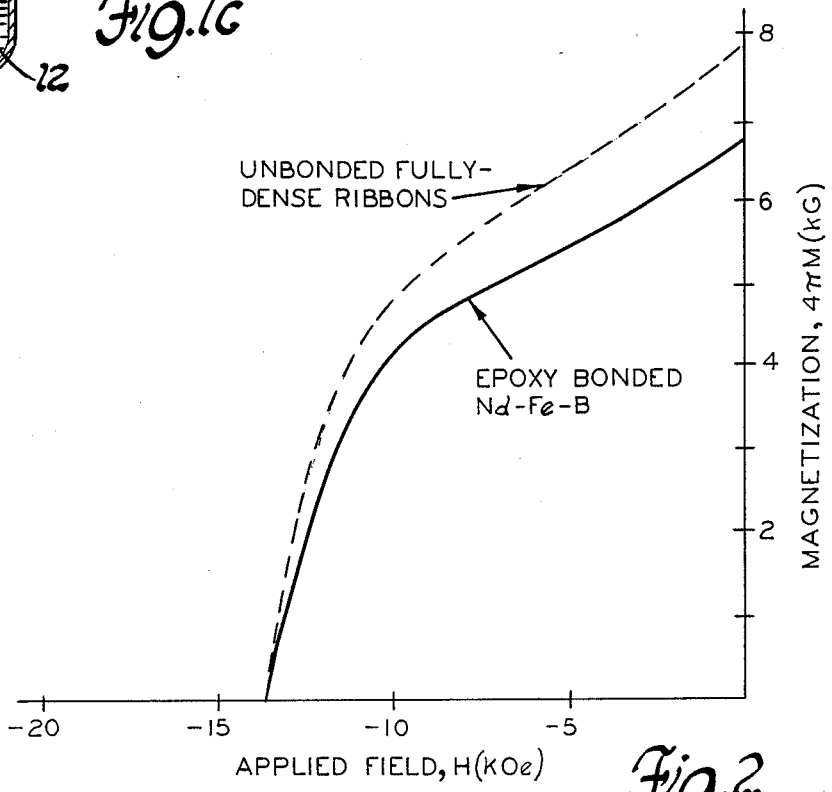
FIG. 2 is a second quadrant demagnetization plot for a bonded magnet made in accordance with the invention compared to the demagnetization of an unbonded sample of melt-spun ribbons of the same rare earth-iron alloy normalized to 100% density.

It was magnetized in the direction of precompaction, i.e. parallel with the original pulsed magnetic field, with a 40 kiloOersted pulsed magnetic field. This was the maximum magnetic field available to us. The field is believed to be too weak to reach magnetic saturation of the RE-Fe-B alloys. Therefore, stronger fields might produce even stronger magnets. The room temperature demagnetization (second quadrant) plot of the hysteresis curve of this bonded magnet composition is shown in FIG. 2. Magnetic measurements were made on a vibrating sample magnetometer, Princeton Applied Research (PAR) Model 155, at a room temperature of about 25° C. The sample was a cube about 2 mm on a side machined from the cylindrical magnet to fix in the magnetometer sample holder.

FIG. 2 compares demagnetization curves for non-bonded powder of the same melt-spun ribbon batch as those used for the compact, corrected to 100% density (i.e., density of the alloy). The density of the alloy ribbon in the compact was 85% of the density of the alloy itself as determined by standard density measurement in water. The bonded magnet formed from the 85% dense compact has a residual magnetic indication of 85% of that of the unbonded melt-spun ribbon corrected to 100% density.

EXAMPLE 2

An experiment was run to determine the difference between (1) a bonded magnet in which the finely ground alloy (less than 45 micron) ribbon particles were concurrently magnetically aligned and prepressed in a pulsed magnetic field, and (2) a bonded magnet formed from unaligned ground alloy particles. Powder particles of the same size and composition as the melt-spun ribbon of Example 1 were precompacted in a plugged rubber sleeve in a hand press but without concurrent application of a magnetic field. The excess rubber at the ends of the sleeves was trimmed away and reinserted in a tool in the hydraulic press. The powder preform was finally compacted at a pressure of about 160 kpsi. The resultant 8 mm thick compact was then fabricated in every other respect identically to the pre-oriented magnet of Example 1. The demagnetization curve for the unaligned bonded magnet was identical to that of the prealigned magnet plotted in FIG. 2.

This experiment illustrates the magnetically isotropic behavior of the melt-spun, rapidly quenched alloy particles. The sieved powder included all particle fractions smaller than 45 micron meters, with many particles smaller than one micrometer, to align. If the smallest particles were near enough single domain size they would be expected to align along the field lines during the alignment step of Example 1. When so aligned and magnetized in the same direction, the resultant magnets should have measurably higher residual induction and a more square hysteresis loop than unoriented magnet counterparts if the method had achieved near domain size, magnetically anisotropic alloy particles. Thus, while the very finely crystalline alloys may be made up of very tiny crystallites which would be expected to have preferred axes of magnetic alignment, apparently, they cannot be ground finely enough by ball milling to take advantage of magnetic alignments during the pressing step. We do not believe that using other state-of-the art milling techniques would provide different results so far as the creation of near domain size, anisotropic particles from the subject melt-spun alloys is concerned.

Another proof of the isotropic nature of the ribbon particles was made as follows. The prepulsed and compacted bonded magnet sample (2×2 mm cube) of Example 1 was demagnetized. The sample was then pulsed in a 40 kOe field in a direction transverse to the original direction of magnetic alignment. The demagnetization curve for the sample magnetized in the transverse direction was then taken. It was exactly the same as the demagnetization curve taken for the original alignment direction (shown in FIG. 2). Because the demagnetization curves were the same for magnetization in the direction of alignment during compaction and for demagnetization transverse thereto, it must be concluded that there was no magnetic alignment of particles in the pulsed precompaction. That is, the ground powders and bonded compacts are both magnetically isotropic.

EXAMPLE 3

Figure 3:
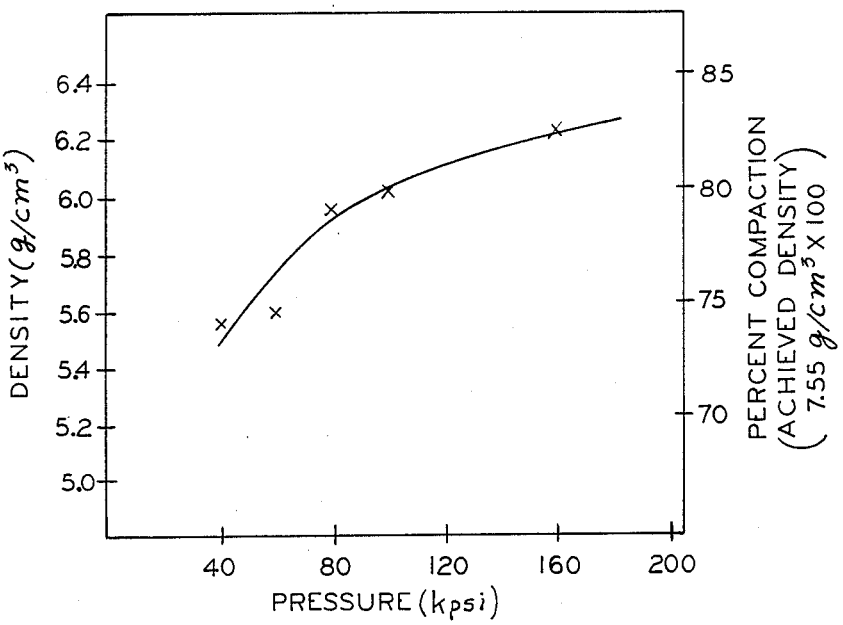
FIG. 3 is a plot of compact density as a function of uniaxial compaction pressure for a right circular cylindrical magnet body formed of melt-spun rare earth-iron ribbon.

A comparison was made between isostatically and uniaxially pressed magnets made from unground $Nd_{0.2}(Fe_{0.95}B_{0.05})_{0.8}$ alloy ribbon particles. The ribbons initially had a cross-section of approximately 2 mm (width) by 30 microns (thickness). The alloy ribbon as melt-spun was easily fractured into small pieces preparatory to compaction. The relationship of compact density to uniaxially applied pressure for fractured Nd-Fe-B ribbon particles pressed in the direction of the axis of a right circular cylindrical compact is shown in FIG. 3. The compaction curve becomes flatter above about 160,000 pounds per square inch at a density of approximately 83 percent (6.24 grams per $Cm^3$) of the ribbon density (7.53 grams per $Cm^3$).

Figure 5:
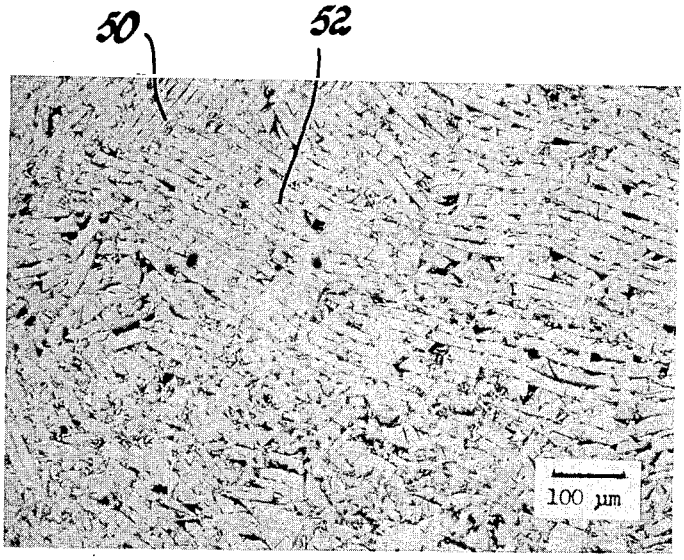
FIGS. 5 and 6 are scanning electron micrographs of cut and polished sections of compacted and epoxy bonded magnets of melt-spun Nd-Fe-B alloy ribbon.
Figure 6:
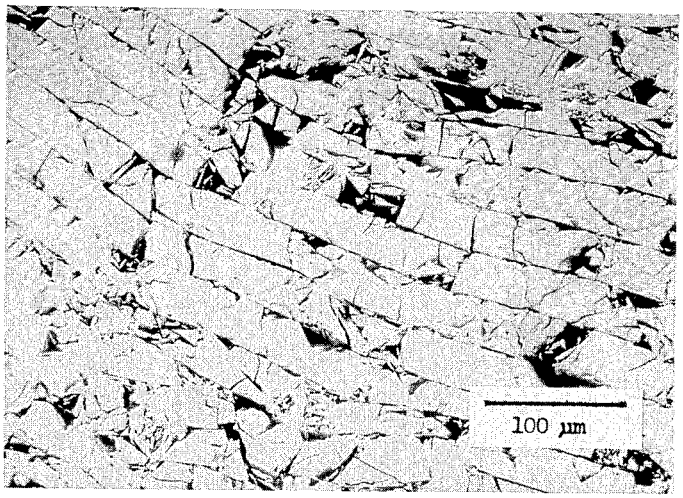

FIGS. 5 and 6 are scanning electron micrographs of isostatically compacted, epoxy bonded magnets made in accordance with this example. In the micrographs, the lighter regions are Nd-Fe-B melt-spun ribbon while the dark regions are epoxy resin or voids. The white line in the lower right-hand corner of each micrograph represents a length of 100 micrometers. Both are plan views of a section of isostatically pressed melt-spun ribbon that was not ground prior to compaction. The ribbon segments each contain many crystallites.

It is clear from FIGS. 5 and 6 that the melt-spun ribbon fractures and compacts in a manner such that individual ribbon segments line up with their long edges substantially parallel to one another. The flat planes of the particles lie facing one another with very little space therebetween. This probably accounts for the high compaction densities. We found that by disposing a sample in an elastic tube, stopping the ends, and isostatically exerting a pressure of 160,000 pounds per square inch, we achieve a compact density of 87% (6.55 grams per $cm^3$). The arrangement of the relatively large ribbon segments also seems to provide the high density compacts with good green strength. Thus with reasonable care they can be handled prior to bonding without breaking or chipping.

Spherical powder particles of a like alloy do not compact well under like conditions. The green compacts are so weak that they cannot be handled prior to bonding.

FIG. 5 especially points out that there are several different regions of ribbon segments oriented parallel to one another in each compact. For example, the particles in the region labeled 50 are oriented at an accute angle with respect to the particles in the region labelled 52.

FIG. 6 shows an enlarged section of a compact where the close packing arrangement of the ribbon segments to one another is clearly visible.

Thus, we have unexpectedly found that melt-spun ribbons of rare earth-iron alloys are relatively easy to compact to densities over 80 percent employing ordinary uniaxial or isostatic pressing means. The compacts have very high green strengths. We have also found that there is no apparent advantage in premilling the alloy compositions. In fact, over-milling ribbon samples was found to adversely affect the magnetics of the material, i.e., reduce the remanent magnetization and energy product of magnets made from the over-milled materials. We have also found that the use of conventional die and powder metal lubricants such as powdered boron nitride does not either adversely or positively affect the compact. However, in practice such lubricants may be desirable to minimize die wear.

Figure 4:
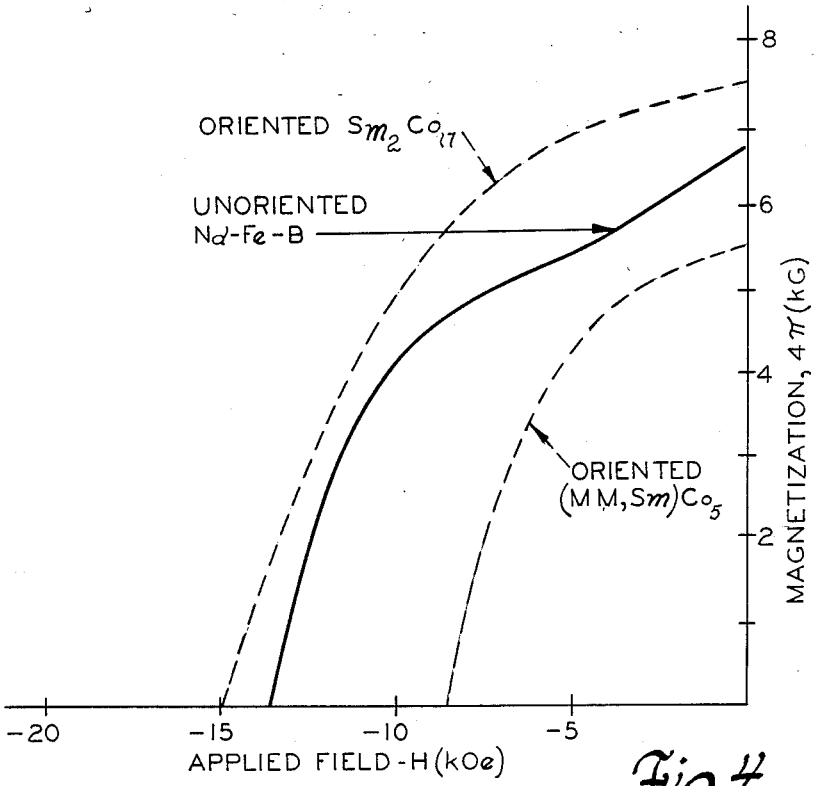
FIG. 4 is a plot comparing second quadrant demagnetization for oriented $Sm_2Co_{17}$ and $SmCo_5$ bonded powder magnets and melt-spun bonded Nd-Fe-B powder magnets.

FIG. 4 qualitatively compares the second quadrant hysteresis of the bonded Nd-Fe-B magnets of the preceding examples with bonded and magnetically prealigned $Sm_2Co_{17}$ and (Sm, mischmetal) $Co_5$ magnets. Oriented $Sm_2Co_{17}$ magnets made from near domain size powder particles, magnetically aligned during compaction, sintered, heat-treated and then finally magnetized exhibit the highest remanent magnetization, $B_r$ of approximately 11 kiloGauss. Sintered oriented Sm-$Co_5$ magnets (substantially 100% density) have a $B_r$ of approximately 8.5 kiloGauss.

The unoriented Nd-Fe-B magnets of this invention fall about midway between the prealigned and bonded $Sm_2Co_{17}$ type and the $SmCo_5$ type magnets. Our magnets are far superior to unaligned bonded Sm-Co magnets.

Oriented ferrite magnets have much lower remanent magnetizationthan our bonded magnets and Alnico's have much lower coercivities. Given the tremendous cost and processing advantages of our magnets, the fact that they approach the magnetic strength of the best oriented rare earth-cobalt magnets makes them highly commercially adaptable.

The strength of our magnets is obviously a function of the quality, i.e., the intrinsic magnetic properties of the constituent melt-spun rare earth-iron alloy. Melt-spun alloys with higher coercivities and remanent magnetization values would produce even stronger hard magnets than those disclosed herein.

In conclusion, we have created novel bonded magnets from fractured and compacted melt-spun rare earth-iron alloy ribbons. The magnets are magnetically isotropic. They do not have to be magnetically prealigned yet they have properties rivaling those of much more expensive bonded samarium cobalt magnets.

The subject method may be used to make cylindrical magnets, arcuate shaped magnets, irregularly shaped magnets, square magnets, and magnets of almost any shape which can be formed by powder metal compaction methods. Never before has it been possible to efficiently and inexpensively produce such high quality permanent magnets of such varying shape from relatively inexpensive starting materials.

While our invention has been described in terms of specific embodiments thereof, other forms may be readily adapted by one skilled in the art. Accordingly, our invention is to be limited only by the following claims.

The embodiments of the invention in which an exclusive property or privilege is claimed are defined as follows:

1. A bonded, magnetically isotropic permanent magnet comprising a bonding agent interspersed with melt-spun, finely crystalline particles comprising, on an atomic percent basis, at least about 10 to about 40 percent of one or more rare earth elements taken from the group consisting of neodymium and praseodymium, at least about 0.5 to about 10 percent boron, and at least about 50 to about 90 percent iron.

2. A bonded, magnetically isotropic permanent magnet comprising a bonding agent interspersed with magnetically isotropic particles comprising, on an atomic percent basis, at least about 50 to about 90 percent iron, at least 10 to about 40 percent of one or more rare earth elements taken from the group consisting of neodymium and praseodymium, and at least about 0.5 to about 18 percent boron.

3. A bonded, magnetically isotropic permanent magnet comprising a bonding agent and magnetically isotropic alloy particles comprising, on an atomic percent basis, up to about 40 percent of one or more rare earth elements where neodymium and/or praseodymium comprise at least about 10 percent of the total composition, up to about 90 percent of one or more transition metals taken from the group consisting of iron, nickel and cobalt including at least about 50 percent iron based on the total alloy composition, and from about 0.5 to 10 percent boron.

4. A bonded, magnetically isotropic permanent magnet comprising a compact of an organic polymeric bonding agent and fractured melt-spun, magnetically isotropic alloy particles comprising, on an atomic percent basis, at least about 50 to 90 percent iron, at least about 10 to about 40 percent of one or more rare earth elements taken from the group consisting of neodymium and praseodymium, and at least about 0.5 to about 18 percent boron, the density of the alloy particles.

5. A bonded permanent magnet comprising magnetically isotropic ribbon particles of a melt-spun alloy containing at least about 10 to about 40 atomic percent neodymium and/or praseodymium, at least about 0.5 to about 18 percent boron and at least about 50 to about 90 atomic percent iron, said particles being bonded together by means of an organic or inorganic bonding agent; and said particles having a substantially brick-like shape and being spatially oriented substantially parallel to each other within regions of the compact to achieve high compact densities and compact green strength; said magnet being equally susceptible to magnetization in any direction in an applied magnetic field such that at a compact density of 80 percent of said alloy the magnet has a magnetic remanence of at least about 6 kiloGauss.

* * * * *